US010301980B2

(12) United States Patent
Stowasser et al.

(10) Patent No.: US 10,301,980 B2
(45) Date of Patent: May 28, 2019

(54) METHOD FOR ADJUSTING AN ACTUATOR ELEMENT FOR A CAMSHAFT OF AN INTERNAL COMBUSTION ENGINE

(71) Applicant: Continental Automotive GmbH, Hannover (DE)

(72) Inventors: Wolfgang Stowasser, Regensburg (DE); Andreas Brunnhoelzl, Hohenau (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 2 days.

(21) Appl. No.: 15/309,898

(22) PCT Filed: Apr. 28, 2015

(86) PCT No.: PCT/EP2015/059255

§ 371 (c)(1),
(2) Date: Nov. 9, 2016

(87) PCT Pub. No.: WO2015/173014

PCT Pub. Date: Nov. 19, 2015

(65) Prior Publication Data

US 2017/0145871 A1 May 25, 2017

(30) Foreign Application Priority Data

May 16, 2014 (DE) ..... 10 2014 209 327

(51) Int. Cl.
*F01L 1/344* (2006.01)

(52) U.S. Cl.
CPC ... *F01L 1/3442* (2013.01); *F01L 2001/34423* (2013.01); *F01L 2001/34426* (2013.01); *F01L 2201/00* (2013.01); *F01L 2800/00* (2013.01)

(58) Field of Classification Search
CPC ..... F01L 1/34409; F01L 2001/3443; F01L 2201/00

(Continued)

(56) References Cited

U.S. PATENT DOCUMENTS 6,644,257 B2 11/2003 Kunz et al. ..... 123/90.17
8,047,065 B2 11/2011 Cinpinski et al. ..... 73/114.79

(Continued)

FOREIGN PATENT DOCUMENTS

DE 102010027520 A1 3/2011 ..... F02D 41/00
DE 102009055864 A1 6/2011 ..... F01L 1/34

(Continued)

OTHER PUBLICATIONS

German Office Action, Application No. 102014209327.9, 4 pages, dated Apr. 20, 2015.

(Continued)

*Primary Examiner* — Jorge L Leon, Jr.
(74) *Attorney, Agent, or Firm* — Slayden Grubert Beard PLLC

(57) ABSTRACT

The present disclosure relates to internal combustion engines. Various embodiments of the teachings may include a method for adjusting an actuator element for a camshaft of an internal combustion engine, wherein the actuator element is coupled to the camshaft to adjust a camshaft setting. The method may include determining a torque imposed by a component of the engine, based on an operating parameter and controlling an adjuster of the actuator to counteract the determined torque and resist adjustment of the actuator element and the camshaft setting. Without controlling the adjuster, the torque is transmitted from the camshaft to the actuator element and can bring about an adjustment of the actuator element and of the camshaft setting. The magnitude of the adjustment corresponds to the torque imposed by the component.

7 Claims, 5 Drawing Sheets

(58) Field of Classification Search
USPC ..... 123/90.17
See application file for complete search history.

(56) References Cited

U.S. PATENT DOCUMENTS

| | | | | |
|---|---|---|---|---|
| 8,567,359 | B2 * | 10/2013 | Ervin | F02D 41/1498 123/90.11 |
| 2005/0103296 | A1 * | 5/2005 | Hirowatari | F01L 1/022 123/90.17 |
| 2008/0135002 | A1 | 6/2008 | Yoshiume et al. | 123/90.12 |
| 2009/0133652 | A1 | 5/2009 | Fujyoshi et al. | 123/90.17 |
| 2013/0268179 | A1 * | 10/2013 | Wang | F02D 13/08 701/105 |
| 2014/0137825 | A1 * | 5/2014 | Brendel | F16F 15/264 123/90.17 |
| 2014/0216373 | A1 * | 8/2014 | Church | F01L 1/3442 123/90.15 |
| 2014/0277999 | A1 * | 9/2014 | Switkes | F02D 13/0219 701/102 |

FOREIGN PATENT DOCUMENTS

| | | | | |
|---|---|---|---|---|
| DE | 102009056024 | A1 | 6/2011 | F01L 1/344 |
| EP | 1272741 | B1 | 8/2004 | F01L 1/34 |
| JP | 2010024985 | A | 2/2010 | F01L 1/34 |
| WO | 2015/173014 | A1 | 11/2015 | F01L 1/344 |

OTHER PUBLICATIONS

International Search Report and Written Opinion, Application No. PCT/EP2015/059255, 14 pages, dated Aug. 21, 2015.

Korean Notice of Allowance, Application No. 201804625841.5, 3 pages, dated Jul. 8, 2018.

Chinese Office Action, Application No. 201580025371.8, 19 pages, dated May 2, 2018.

Korean Office Action, Application No. 2018030535584, 9 pages, dated May 3, 2018.

German Office Action, Application No. 102014209327.9, 7 pages dated Dec. 14, 2018.

* cited by examiner

METHOD FOR ADJUSTING AN ACTUATOR ELEMENT FOR A CAMSHAFT OF AN INTERNAL COMBUSTION ENGINE

CROSS-REFERENCE TO RELATED APPLICATIONS

This application is a U.S. National Stage Application of International Application No. PCT/EP2015/059255 filed Apr. 28, 2015, which designates the United States of America, and claims priority to DE Application No. 10 2014 209 327.9 filed May 16, 2014, the contents of which are hereby incorporated by reference in their entirety.

TECHNICAL FIELD

The present disclosure relates to internal combustion engines. Various embodiments of the teachings may include a method for adjusting an actuator element for a camshaft of an internal combustion engine.

BACKGROUND

Internal combustion engines have a plurality of cylinders which are each coupled to a camshaft and to a crankshaft. The crankshaft takes up piston forces of the individual pistons of the cylinders, said forces being conducted via respective connecting rods, and converts the piston forces into a torque. In this context, the camshaft is held in a defined position using an actuator element.

In modern internal combustion engines, the camshaft position is repeatedly re-adjusted, even during operation, using an actuator element. This requires an actuator element which knows the precise position of the camshaft or determines the ideal camshaft setting on the basis of characteristic diagrams. The required setpoint setting of the camshaft position can then be held with an actuator element. When modern actuator elements are controlled, the maximum achievable control speed is limited owing to the lag times which occur and the delayed response.

Because of the lag times and the delayed response, the controller which controls the actual setting of the camshaft cannot be supplied with an integral component, since otherwise an unstable system would be produced. Therefore, in modern camshaft-adjustment devices a certain maximum control error of the actuator element is permitted, below which error the controller does not react.

If the actual setting of the actuator element, and therefore of the camshaft, cannot be measured continuously but instead is determined by means of sampling, problems may occur, since even after repeated engagement of the controller the setpoint setting is not reached and instead a quasi-steady-state is set.

This resulting drift, which does not originate from changed operating parameters of the actuator element, is currently compensated using a load-dependent and rotational-speed-dependent characteristic diagram.

EP 1 272 741 B1 discloses a method for finding the holding pulse duty factor which is required to hold an actuator element in a desired setpoint setting. This method essentially relies on the fact that the minimum of the through-flow characteristic curve is determined by the operating parameters of the solenoid valve. In this context, an actuator element can be moved between two end settings. The actuator element is acted on in one end setting, and can be moved to another end setting by activating an adjustment unit. In this context, the actual setting of the actuator element is determined by sampling. The actuator element is then actuated by means of a pulse-width-modulated signal, and is held in a setpoint setting using an actuation with the holding pulse duty factor. If a control error is continuously exceeded despite a repeated control intervention, the holding pulse duty factor is adapted.

In modern internal combustion engines with a camshaft-adjustment system, new dependencies arise owing to current tendencies. These new dependencies emerge, in particular, for example as a result of a drop in oil pressure, more compact design of the camshaft adjusters, the drive of additional components via the camshaft and variable camshaft geometries.

SUMMARY

The teachings of the present disclosure may be embodied in a method for operating an internal combustion engine, an engine control unit for an internal combustion engine, and/or a computer program for adjusting an actuator element for a camshaft of an internal combustion engine. The teachings of the present disclosure may be employed to adjust an actuator element for a camshaft in an internal combustion engine, which actuator element holds a desired camshaft setting of a camshaft in a stable fashion.

Some embodiments of the teachings may include a method for adjusting an actuator element (200) for a camshaft (201) of an internal combustion engine, wherein the actuator element (200) is coupled to the camshaft (201) in such a way that a camshaft setting can be adjusted. The method may include: determining a torque which transmits a component of the internal combustion engine to the camshaft (201) and controlling an adjuster (300) of the actuator element (200) on the basis of the torque in such a way that the torque is counteracted, and the adjustment (202) of the actuator element (200) and of the camshaft setting is prohibited. The torque may be determined on the basis of at least one operating parameter of the component. The torque may be transmitted from the camshaft (201) to the actuator element (200), with the result that the torque can bring about an adjustment (202) of the actuator element (200) and of the camshaft setting. The size of the adjustment (202) may be indicative of the torque of the component.

Some embodiments may include determining a further torque which transmits a further component of the internal combustion engine to the camshaft (201). The further torque may be determined on the basis of at least one further operating parameter of the further component. The further torque may be transmitted from the camshaft (201) to the actuator element (200), with the result that the further torque can bring about an adjustment (202) of the actuator element (201) and of the camshaft setting. The size of the adjustment (202) may be indicative of the torque and of the further torque. The control of the adjuster (300) of the actuator element (200) may be based on the torque and the further torque in such a way that the torque and the further torque are counteracted and the adjustment (202) of the actuator element (200) and of the camshaft setting is prohibited.

In some embodiments, the actuator element (200) has a hydraulic actuator element, and the adjuster (300) controls a mass flow of a hydraulic fluid to and from the hydraulic actuator element in order to adjust a setpoint setting of the actuator element (200). The step of controlling the adjuster (300) may also comprise controlling the mass flow of the hydraulic fluid to and from the hydraulic actuator element with the adjuster (300) on the basis of the determined torque.

In some embodiments, the hydraulic actuator element has a vane cell adjuster (200). The vane cell adjuster may have an inner ring (204) and an outer ring (205) which is spaced apart radially from the inner ring (204), with the result that a volume is formed between the inner ring (204) and the outer ring (205). The inner ring (204) can be rotated relative to the outer ring (205). The inner ring (204) may have an inner dividing wall (206) which projects radially from the inner ring (204) into the volume, wherein the outer ring (205) has an outer dividing wall (207) which projects radially from the outer ring (205) into the volume, wherein the inner dividing wall (206) and the outer dividing wall (207) form a spaced-apart first chamber (208) and a second chamber (209) in the circumferential direction.

In some embodiments, a fluid can be made available with a first pressure in the first chamber (208), and the fluid can be made available with a second pressure in the second chamber (209), with the result that relative adjustment of the inner ring (204) with respect to the outer ring (205) can be made available.

In some embodiments, the step of controlling the adjuster (300) also comprises controlling the mass flow of the hydraulic fluid to and from the first chamber (208) and the second chamber (209), with the result that a setting of the inner ring (204) relative to the outer ring (205) is adjusted. The setting of the inner ring (204) relative to the outer ring (205) may be indicative of the camshaft setting.

In some embodiments, the vane cell adjuster also has a shaft (210) which is coupled to the inner ring (204) or the outer ring (205). The shaft may be coupled to the camshaft (201) in such a way that adjustment of the shaft brings about adjustment of the camshaft (201).

Some embodiments may include an engine control unit for an internal combustion engine, wherein the engine control unit is configured in such a way that the method as described above can be executed.

Some embodiments may include a computer program for adjusting an actuator element (200) for a camshaft (201) of an internal combustion engine, wherein the computer program is configured to carry out the method as described above.

BRIEF DESCRIPTION OF THE DRAWINGS

In the text which follows, for the sake of further explanation and for better understanding of the present invention, exemplary embodiments will be described in more detail with reference to the appended figures, of which.

Identical or similar components are provided with identical reference numbers in the figures. The illustration in the figures is schematic and not to scale.

DETAILED DESCRIPTION

Figure 1:
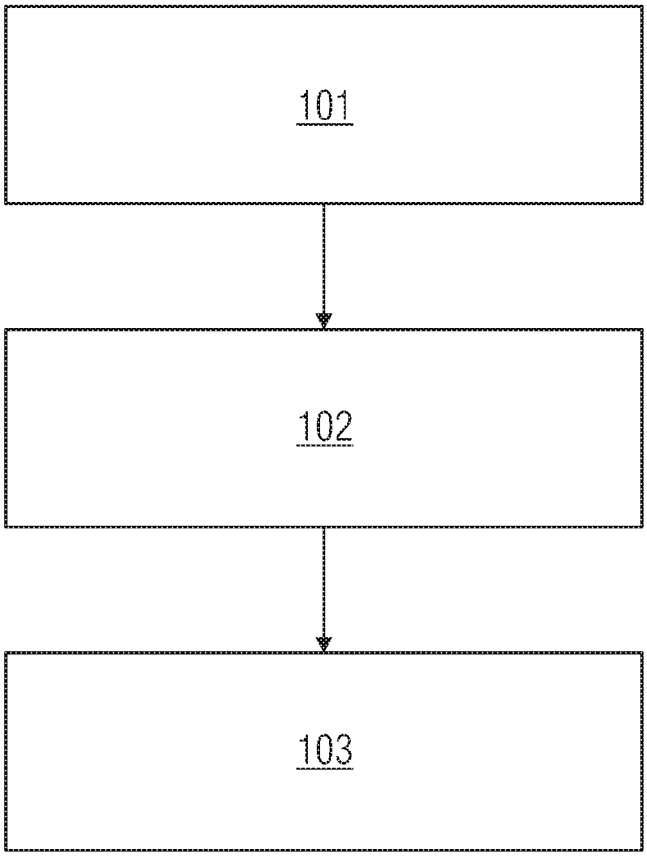
FIG. 1 is a schematic view of individual method steps of the method for adjusting an actuator element for a camshaft of an internal combustion engine according to teachings of the present disclosure.

Some embodiments may include a method for adjusting an actuator element for a camshaft of an internal combustion engine is described. The actuator element is coupled to the camshaft in such a way that a camshaft setting can be adjusted.

In some embodiments, a torque is determined which transmits a component of the internal combustion engine to the camshaft, wherein the torque is determined on the basis of at least one operating parameter of the component. The torque is transmitted from the camshaft to the actuator element, with the result that the torque can bring about an adjustment of the actuator element and of the camshaft setting. The size of the adjustment is indicative of the torque of the component.

In some embodiments, an adjuster of the actuator element is controlled on the basis of the torque in such a way that the torque is counteracted, and the adjustment of the actuator element and of the camshaft setting is prohibited.

In modern internal combustion engines, the one desired cam setting of the camshaft is adjusted by means of actuator elements in order to set or adjust desired valve opening times and valve opening points in time of gas exchange valves of the internal combustion engine. For example, in the case of a cold start of the internal combustion engine different valve settings can be set than during a normal operation of the internal combustion engine.

The cam setting of the camshaft can be adjusted, for example, as a function of operating parameters of the internal combustion engine. The operating parameters of the internal combustion engine are, for example, the engine rotational speed and the air mass which is used for the combustion. In addition, the outside temperature, the temperature of the fuel, or the ambient pressure can also be used.

The cam setting of the camshaft can be determined on the basis of the operating parameters of the internal combustion engine from a predefined characteristic diagram of the internal combustion engine. The relationship between the operating parameters and the cam setting can be read off here from a characteristic diagram which is, for example, a load-dependent and rotational-speed-dependent characteristic diagram.

The actuator element is coupled to the camshaft in a rotationally fixed fashion, with the result that torques are transmitted from the camshaft to the actuator element. The actuator element is rotated into a desired setting by means of the adjuster, to set the desired camshaft setting. As is described further below in detail, the actuator element of the adjuster can be operated by means of hydraulic fluid.

In modern internal combustion engines, a wide variety of components of the internal combustion engine are driven via the camshaft. A component which is, for example, also driven via the camshaft is an injection pump or a brake booster. The torques which the components transmit to the camshafts are dependent on at least one operating parameter of the component. The torque which is transmitted to the camshaft via components such as, for example, the injection pump, is higher or lower depending on the power level with which said component is operated. In the case of the injection pump, the torque acting on the camshaft is dependent essentially on the operating parameter of the volume flow of the fuel and the operating parameter of the change in pressure. However, it is also possible, for example, to connect the pump for the brake booster to the camshaft. In contrast to the injection pump, the pump of the brake booster is, however, only driven when necessary and with a constant torque.

It is known how high the torque of a component is under determined operating parameters. If, for example, the injection pump is operated with a specific power level, the torque of the component which is transmitted to the camshaft can be determined therefrom. Direct measurement of the transmitted torque is not necessary here. In addition, as soon as the component is actuated with determined operating parameters it is possible to infer the torque which is transmitted to the camshaft, and the adjuster is therefore correspondingly adjusted.

The torque which is transmitted from the component to the camshaft and therefore to the actuator element brings about adjustment of the camshaft setting or of the actuator element. It is known how large the dependency between a possible adjustment and the transmitted torque of the component is. In other words, the size of the adjustment can be determined in accordance with the size of the torque transmitted from the component to the camshaft.

It is therefore possible to adjust the actuator element correspondingly by means of the adjuster in accordance with the knowledge of the torque being transmitted from the component to the camshaft, and the torque is therefore counteracted and the adjustment of the actuator element or of the camshaft setting is prohibited.

In some embodiments, the method includes determining the so-called interference variables or torques which act on the camshaft and therefore on the actuator element by means of the components, and compensating them by modeling and performing pilot-control of the actuator element. The quality of the control of the actuator element, which ultimately has a direct influence on, for example, the ignition behavior, the emissions, and the consumption of the internal combustion engine, increases as a result of the prohibition or compensation of the adjustment (referred to as drift) by keeping the actuator element in a desired setting by controlling the adjuster.

In some embodiments, a further torque is determined which transmits a further component of the internal combustion engine to the camshaft. The further torque is determined on the basis of at least one further operating parameter of the further component, wherein the further component is transmitted from the camshaft to the actuator element, with the result that the further torque can bring about an adjustment of the actuator element and of the camshaft setting. The size of the adjustment is indicative of the torque and the further torque. The control of the adjuster of the actuator element is based on the torque and the further torque in such a way that the torque and the further torque are counteracted and the adjustment of the actuator element and of the camshaft setting is prohibited.

The sum of all the torques of the components which act on the camshaft can be taken into account in order to control the actuator element correspondingly by means of the adjuster. The total torque which acts on the actuator element, and from which the size of the adjustment (referred to as drift) can be derived, corresponds to the sum of all the torques which are additionally transmitted to the camshaft from components. This can be represented with the equation $$M_{Actuator\ element}=M_{Component\ 1}+M_{Component\ 2}+\ldots+M_{Component\ n},$$

The torque of the actuator element can also be dependent, inter alia, on the pressure transmission ratio within the actuator element, a constant determined characteristic variable and the oil pressure which is present. Examples of the components 1 to n can be, for example, the connected injection pump.

In the case of the injection pump, the torque which is transmitted to the camshaft can be dependent on the operating parameter of the volume flow of the fuel and the operating parameter of the change in pressure. The torque of the pump for the brake booster which can constitute one of the n components can be dependent on the operating parameter of the volume flow of the air and on the operating parameter of the change in pressure.

The frictional torque of the camshaft in the case of systems with different strokes is also variable. These systems can be understood to be a component as described above. In addition, on the outlet side the valve is opened counter to different cylinder internal pressures as operating parameters depending on the phase, and the torque acting on the camshaft therefore changes.

In addition, depending on the configuration of the internal combustion engine, further consumers or components can also be included in the balance equation of the torque $M_{Actuator\ element}$ acting on the actuator element.

In some embodiments, the actuator element has a hydraulic actuator element, and the adjuster has a hydraulic adjuster. The adjuster controls a mass flow of a hydraulic fluid to and from the hydraulic actuator element, to adjust a setpoint setting of the actuator element. The step of controlling the adjuster also comprises controlling the mass flow of the hydraulic fluid to and from the hydraulic actuator element with the adjuster on the basis of the determined torque.

The total torque acting on the hydraulic actuator element brings about, in particular, the adjustment thereof (referred to as drift), since leaks are brought about within the hydraulic actuator element owing to the loading of the total torque. The fluid flow as a result of the leaks which bring about the adjustment (drift) within the hydraulic actuator element is not constant but rather also subject to fluctuations. The fluctuations are caused by varying torques of the components which act on the camshaft and therefore on the actuator element and on the hydraulic adjuster. The varying torques $M_{Component\ 1\text{-}n}$ of the components are based, for example, on different operating points of the components or also arise as a result of the change in the viscosity of the oil, as a result of the temperature and ageing of the components or of the internal combustion engine and/or as a result of the changing torques acting on the actuator element and therefore on the hydraulic adjuster. The torques of the all components involved in the leaks are, as explained above, balanced in order to determine the deviation caused by the leak within the hydraulic adjuster of the actuator element.

In some embodiments, the hydraulic actuator element has a vane cell adjuster. In one example of a vane cell adjuster, it includes an inner ring and an outer ring spaced apart radially from the inner ring, with the result that a volume is formed between the inner ring and the outer ring. The inner ring can be rotated relative to the outer ring, wherein the inner ring has an inner dividing wall which projects radially from the inner ring into the volume. The outer ring has an outer dividing wall which projects radially from the outer ring into the volume, wherein the inner dividing wall and the outer dividing wall form a spaced-apart first chamber and a second chamber in the circumferential direction. A fluid can be made available with a first pressure in the first chamber, and the fluid can be made available with a second pressure in the second chamber, with the result that relative adjustment of the inner ring with respect to the outer ring can be made available.

In some embodiments, the step of controlling the adjuster also comprises controlling the mass flow of the hydraulic fluid to and from the first chamber and the second chamber, with the result that a setting of the inner ring relative to the outer ring is adjusted. The setting of the inner ring relative to the outer ring is indicative of the camshaft setting.

In some embodiments, the vane cell adjuster includes a shaft which is coupled to the inner ring or the outer ring, wherein the shaft is coupled to the camshaft in such a way that adjustment of the shaft brings about adjustment of the camshaft. The rings are interleaved radially in one another and can also each be embodied as a hollow cylinder. In this context, at least one dividing wall projects radially outward from the inner ring into the volume, and at least one dividing wall projects radially inward from the outer ring into the volume. The vane cell adjuster can also have more than one dividing wall in each case.

If this is the case, both the inner ring and the outer ring have the same number of dividing walls. The dividing walls are then also each arranged on the inner ring and on the outer ring in such a way that an inner dividing wall always follows an outer dividing wall in the circumferential direction. As a result, first chambers and second chambers which are spaced apart in the circumferential direction by the at least one inner dividing wall and the at least one outer dividing wall are formed. The rotatability of the inner ring relative to the outer ring has the result that the volumes of the at least one first chamber and the at least one second chamber which are formed are variable. Changing the volume of a chamber by relative rotation of the inner ring with respect to the outer ring has the result that all the volumes which are formed change in dependence on one another.

In the vane cell adjuster, either the inner ring or the outer ring can be coupled to a shaft. This ensures that either the inner ring or the outer ring serves as a rotor, and the respective other ring serves as a stator. The shaft of the actuator element is in turn coupled in a frictionally locking fashion to the camshaft. As a result of this, a rotation of the shaft brings about a rotation of the camshaft and a rotation of the camshaft in turn brings about a rotation of the shaft. As a result, a rotation of the camshaft can bring about a change in the volumes of the at least one first chamber and the at least one second chamber. Likewise, the changing of the volumes of the at least one first chamber and of the at least one second chamber can result in the cam setting of the camshaft changing, and therefore the desired cam setting being set.

In the vane cell adjuster, a fluid with a first pressure can be made available in the first chamber, and a fluid with a second pressure can be made available in the second chamber, with the result that a relative adjustment of the inner ring with respect to the outer ring can be made available. Both the at least one first chamber and the at least one second chamber are supplied with a fluid.

Each of the at least one first chambers is supplied here with a fluid with a first pressure, and each of the first chambers is respectively connected to a first fluid line which connects the at least one first chamber to a first fluid reservoir. Each of the at least one second chambers is supplied with a fluid with a second pressure, and each of the second chambers is respectively connected to a second fluid line which connects the at least one second chamber to a second fluid reservoir. By changing the first pressure and/or the second pressure it is possible to implement a relative adjustment of the inner ring relative to the outer ring.

The method also comprises controlling a setting of the inner ring relative to the outer ring additionally by adjusting the first pressure in the first chamber and the second pressure in the second chamber. The fact that the at least one first chamber and the at least one second chamber in the vane cell adjuster can be supplied with fluid with a determined pressure independently of one another and the fluid can flow from one of the at least one first chambers into one of the at least one second chambers, and vice versa, as a result of the small leaks at the tips of the at least one inner dividing wall and the at least one outer dividing wall, resuts in that the relative setting of the inner ring with respect to the outer ring can be controlled. Therefore, the cam setting of the camshaft can also be controlled to a defined and determined position.

In some embodiments, a method for operating an internal combustion engine is described, wherein, in particular, the methods described above are carried out.

In some embodiments, an engine control unit for an internal combustion engine is described, wherein the engine control unit is configured in such a way that the methods described above can be carried out in order to set an actuator element for a camshaft of an internal combustion engine.

The motor control unit can have, for example, a programmable process. In addition, the engine control unit can have a database which contains various data items, such as data items relating to the various measurement variables which are measured during the operation of the internal combustion engine, output and stored in the engine control unit, and parameters, such as for example the oil pressure, volume flow of the fuel, change in pressure, camshaft stroke, phase of the outlet camshaft, time for actuating the pump of the brake booster. These variables are either already present in the database of the engine control unit or can be determined from the present variables by means of the engine control unit.

The operating parameters of the internal combustion engine or of the components which are required for modeling, such as, for example, the oil pressure, volume flow of the fuel, change in pressure, camshaft stroke, phase of the outlet camshaft, time for actuating the pump of the brake booster, are either present in the engine control unit or can be derived from already present measured parameters.

In some embodiments, a computer program for setting an actuator element for a camshaft of an internal combustion engine is described. The computer program is configured to carry out the methods described above if the computer program is executed by a processor. The naming of such a computer program is equivalent to the term computer program element, a computer program product and/or a computer-readable medium which contains instructions for controlling a computer system in order to suitably coordinate the mode of operation of a system, or of a method, in order to achieve the effects linked with the method according to the invention.

The computer program can be implemented as a computer-readable instruction code in any suitable programming language such as, for example, JAVA, C++ etc. The computer program can be stored on a computer-readable storage medium (CD-rom, DVD, Blu-Ray disk, removable drive, volatile or non-volatile memory, built-in memory/processor etc.). The application code can program a computer or other programmable devices such as, in particular, a control device or the engine control unit described above for an internal combustion engine of a motor vehicle in such a way that the desired functions are executed. In addition, the computer program can be made available in a network such as, for example, the Internet, from which it can be downloaded as necessary by a user.

The teachings herein can be implemented either by means of a computer program, a software package, or by means of one or more specific electrical circuits using hardware and/or firmware or in any desired hybrid form by means of mixed software components and hardware components.

The embodiments described here merely represent a limited selection of possible embodiment variants of the invention. It is possible to combine the features of individual embodiments in a suitable form with one another, with the result that for a person skilled in the art the embodiment variants which are explicit here disclose a multiplicity of various embodiments.

FIG. 1 is a schematic view of individual method steps of a method for adjusting an actuator element 200 for a camshaft 201 of an internal combustion engine according to teachings of the present disclosure. The actuator element 200 is coupled to the camshaft 201 in such a way that a camshaft setting can be adjusted.

In step 101, a torque is determined which is transmitted to the camshaft 201 by a component of the internal combustion engine, wherein the torque is determined on the basis of at least one operating parameter of the component. The torque is transmitted from the camshaft 201 to the actuator element 200, with the result that the torque can bring about adjustment 202 of the actuator element 201 and of the camshaft setting. The size of the adjustment 202 is indicative of the torque of the component.

In step 103, an adjuster 300 of the actuator element 200 is controlled on the basis of the torque in such a way that the torque is counteracted and the adjustment 202 of the actuator element 200 and of the camshaft setting is prohibited.

The cam setting of the camshaft 201 can be adjusted, for example, in accordance with operating parameters of the internal combustion engine. The operating parameters of the internal combustion engine are, for example, the engine rotational speed and the air mass which is used for the combustion. In addition, the outside temperature, the temperature of the fuel or the ambient pressure is used.

The actuator element 200 is coupled in a rotationally fixed fashion to the camshaft 201, with the result that torques are transmitted from the camshaft 201 to the actuator element 200. The actuator element 200 is rotated into a desired setting by means of the adjuster to set the desired camshaft setting.

In modern internal combustion engines, a wide variety of components of the internal combustion engine are driven via the camshaft 201. A component which is also driven via the camshaft is, for example, an injection pump or a brake booster. It is known how high the torque of a component is in the case of determined operating parameters. If, for example, the injection pump is operated with a determined power level, the torque of the component which is transmitted to the camshaft 201 can be determined therefrom. In addition, as soon as the component is actuated with determined operating parameters the torque which is transmitted to the camshaft 201 can be inferred, with the result that the adjuster 300 is correspondingly adjusted.

The torque which is transmitted from the component to the camshaft 201 and therefore to the actuator element 200 brings about an adjustment of the camshaft setting or of the actuator element 200. It is known how large the dependency is between a possible adjustment and the transmitted torque of the component. In other words, the size of the adjustment can be determined in accordance with the size of the transmitted torque from the component to the camshaft 201.

Therefore, the actuator element 200 can be correspondingly adjusted by means of the adjuster 300 in accordance with the knowledge of the torque being transmitted from the component to the camshaft 201, such that the torque is counteracted and the adjustment of the actuator element 200 or of the camshaft setting is prevented.

In addition, in step 102 for example a further torque which is transmitted by a further component of the internal combustion engine to the camshaft 201 can be determined. The further torque is determined on the basis of at least one further operating parameter of the further component, wherein the further torque is transmitted from the camshaft 201 to the actuator element 200, with the result that the further torque can bring about an adjustment of the actuator element 200 and of the camshaft setting. The size of the adjustment is indicative of the torque and of the further torque. The control of the adjuster 300 of the actuator element 200 is based on the torque and the further torque in such a way that the torque and the further torque are counteracted and the adjustment of the actuator element 200 and of the camshaft setting is prevented.

Figure 2:
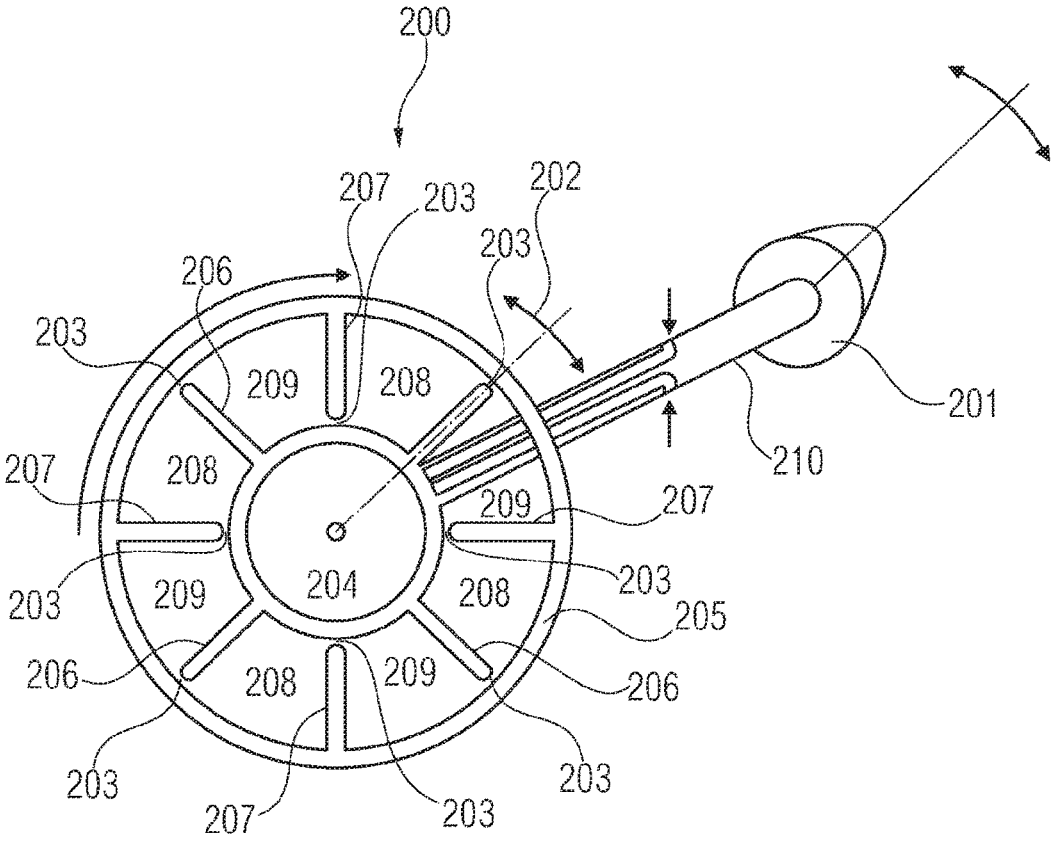
FIG. 2 shows a schematic illustration of a vane cell adjuster according to teachings of the present disclosure.

FIG. 2 shows a schematic illustration of the actuator element 200 which is embodied, for example, as a vane cell adjuster 200. The vane cell adjuster 200 comprises an inner ring 204, an outer ring 205 and a shaft 210. The shaft 210 of the vane cell adjuster 200 is connected in a frictionally locking fashion to the camshaft 201. In this embodiment, "connected in a frictionally locking fashion" means that the shaft 210 of the vane cell adjuster 200 is coupled to the camshaft 201 in such a way that a torque which is taken up by the camshaft 201 and transmitted is also transmitted directly to the shaft 210 of the vane cell adjuster 200, and the shaft 210 then transmits the same torque as the camshaft 201. Alternatively, the shaft 210 can also pass on a torque acting on it to the camshaft 201 in such a way that the same torque acts on the camshaft 201 as on the shaft 210.

The inner ring 204 is coupled to the shaft 210, with the result that torques acting on the shaft 210 result in a relative rotation of the inner ring 204 with respect to the outer ring 205. Alternatively, the outer ring 205 can be coupled to the shaft 210, with the result that in this case the torque which is transmitted to the shaft 210 results in a relative rotation of the outer ring 205 with respect to the inner ring 204. It is to be noted that either the inner ring 204 or the outer ring 205 is connected to the shaft 210. The respective ring 204, 205 which is connected to the shaft 210 then serves as a rotor of the vane cell adjuster 200, and the other ring 204, 205 serves as a stator. FIG. 2 illustrates the case in which the inner ring 204 serves as a rotor, and the outer ring 205 serves as a stator. The inner ring 204 and the outer ring 205 are spaced apart radially from one another in such a way that they define a radial volume between one another.

Furthermore, the inner ring 204 has at least one inner dividing wall 206 which extends radially from the inner ring 204 in the direction of the outer ring 205. The outer ring 205 has at least one outer dividing wall 207 which extends radially from the outer ring 205 in the direction of the inner ring 204. In the volume between the inner ring 204 and the outer ring 205, the at least one inner dividing wall 206 and the at least one outer dividing wall 207 form at least one first chamber 208 and at least one second chamber 209 which are spaced apart in the circumferential direction. The circumferential direction is in this embodiment the direction in which either the inner ring 204 or the outer ring 205 rotates about the axis of the shaft of the vane cell adjuster 200.

In the exemplary embodiment shown in FIG. 2, the inner ring 204 has four inner dividing walls 206, and the outer ring 205 has four outer dividing walls 207. Any desired number of inner dividing walls 206 and outer dividing walls 207 can occur in a vane cell adjuster 200 as long as the latter has at least one inner dividing wall 206 and at least one outer dividing wall 207, and the number of the inner dividing walls 206 corresponds to the number of outer dividing walls 207. This precisely identical number has the result that a first chamber 208 and a second chamber 209 are always formed alternately in the circumferential direction. This arrangement and number of the at least one inner dividing walls 206 and of the at least one outer dividing walls 207 also ensures that a relative adjustment 202 of the inner ring 204 is able to be carried out relative to the outer ring 205.

Small gaps, referred to as leaks 203 can occur in the radial direction between the inner dividing walls 206 and the outer ring 205. Small gaps, referred to as leaks 203 can occur in the radial direction between the outer dividing walls 207 and the inner 204. As a result of these leaks 203 which are present at the inner ring 204 fluid can flow from a second chamber 209 into a first chamber 208. These leaks 203 which are present at the outer ring 205 can also allow fluid to flow from the first chamber 208 into a second chamber 209. These leaks 203 should be as small as possible with the result that a preset setpoint setting can be maintained as precisely as possible by the vane cell adjuster 200. Since the quantity of the fluid exchanged between the first chambers 208 and second chambers 209 via the leaks depends on the size of the torque transmitted to the shaft 210 and on other operating parameters, the leaks 203 are different depending on the operating state and the use. To be more precise, the leaks are not different but instead the quantity of fluid which is transmitted between the first chambers 208 and the second chambers 209 via the leaks is different.

If an additional torque is transmitted to the camshaft 201 and therefore to the shaft 210 in this exemplary embodiment of the present invention, this results in the relative setting 202 of the inner ring 204 with respect to the outer ring 205 being shifted in the clockwise direction. In this exemplary embodiment this results in the pressure in e.g. the first chamber 208 increasing compared to a pressure in the other second chamber 209, and the volumes of the first chambers 208 are increased and those of the second chambers 209 are decreased. As a result, fluid flow is produced through the leaks 203 in order to equalize the pressure difference between the chambers 208, 209. This results in turn to an undesired adjustment 202 of the actuator element 200.

The fluid flow as a result of the leakages 203 can be determined in advance on the basis of the knowledge of the operating states of the components coupled to the camshaft 201 and therefore on the basis of the knowledge of the transmitted torques of the components to the actuator element 200, and the adjuster 300 can actively feed fluid into the corresponding chamber 208, 209 or actively discharge fluid therefrom in order to equalize the fluid flow as a result of the leaks 203. The pressure in the corresponding chambers 208, 209 is therefore kept constant, with the result that an undesired adjustment 202 of the actuator element 200 is prevented.

Figure 3:
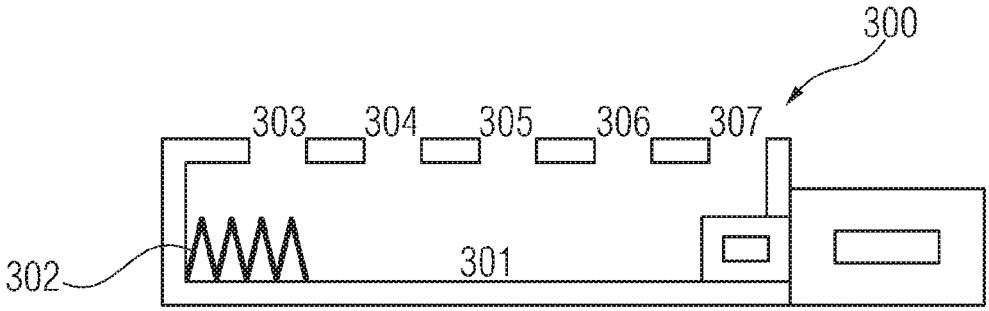
FIG. 3 shows the position of the control piston for controlling the supply of fluid to a first chamber and a second chamber of a vane cell adjuster with a pulse duty factor of 50% according to teachings of the present disclosure.

FIG. 3 shows a hydraulic adjuster 300 according to teachings of the present disclosure, which adjuster 300 adjusts the vane cell adjuster 200 into a predefined position and holds it there. The adjuster 300 has a control piston 301 which can direct various fluid flows into the corresponding chambers 208, 209 of the vane cell adjuster 200. The adjuster 300 has a spring 302. The control piston 301 directs the fluid supply of the fluid into the first chambers 208 and into the second chambers 209. For this, the adjuster 300 has, in the exemplary embodiment, a plurality of connections through which fluid can selectively flow by controlling the control piston 301. The connections are in this exemplary embodiment a first outflow 303 to a fluid trough (e.g. oil trough), a first fluid line 304 to the at least one first chamber 208, a connection 305 through which pressurized fluid flows, a second fluid line 306 to the at least one second chamber and a second outflow 307 to the fluid trough.

FIG. 3 illustrates the position of the control piston 301 for controlling the supply of the fluid into the at least one first chamber 208 and the at least one second chamber 209 in the case of a pulse duty factor of 50%. In this setting, no fluid flows via the lines to the fluid trough or into the chambers 208, 209 or out of them. In this setting, the leaks 203 are the only possible way for fluid to flow from a first chamber 208 into a second chamber 209 or vice versa. In the case of a pulse duty factor of 50% (center position of the control piston 301 in FIG. 3), the control piston 301 closes the first fluid line 304 and the second fluid line 306 to the fluid trough.

A pulse duty factor of 100% corresponds to a setting of the control piston 301 in which fluid flows from the connection 305 into the first fluid line 304 to the first chambers 208, and fluid flows from the second chambers 209 via the second fluid line 306 to the second outflow 307. In this way for example the first chambers 108 are filled with additional fluid and the second chambers 209 are emptied (see FIG. 4).

A pulse duty factor of 0% corresponds to a setting of the control piston 301 in which fluid flows from the connection 305 into the second fluid line 306 to the second chambers 209, and fluid flows from the first chambers 208 via the first fluid line 304 to the first outflow 303. In this way, for example the second chambers 109 are filled with additional fluid and the first chambers 208 are emptied (see FIG. 5).

If then a torque from a component is applied to the camshaft 201, a pressure difference is produced between the first chamber 208 and the second chamber 209 and fluid flows through the leaks 203, with the result that the actuator element 200 would be adjusted. In order to counteract this flow of fluid through the leaks 203, the control piston 301 is correspondingly adjusted, with the result that the corresponding fluid is made available again with a controlled mass flow in the chambers 208, 209, and an adjustment on the basis of the fluid discharge or fluid inflow is prohibited. Depending on the size of the torques which are transmitted from the components to the camshaft, correspondingly large leakage flows are produced as a result of the leaks 203, with the result that correspondingly more fluid must flow into the chambers 208, 209 or be discharged therefrom.

The pulse duty factor of the control piston 301 in which a fluid flow into or out of the corresponding chambers 208, 209 is set in such a way that the fluid flow as a result of the leaks 203 is equalized by the supply and discharge of fluid in or out of the chambers, and therefore no adjustment 202 of the actuator element 200 is brought about, is referred to as a holding pulse duty factor. The holding pulse duty factor can typically be between 30% and 70%. This means that the control piston 301 is correspondingly closer to the 0% pulse duty factor (see FIG. 5) or the 100% pulse duty factor (see FIG. 4).

Figure 4:
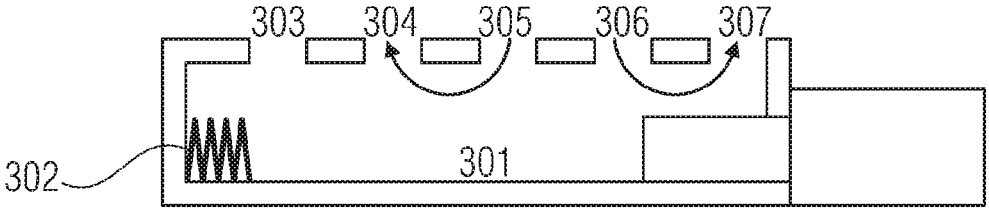
FIG. 4 shows the position of the control piston for controlling the supply of fluid into a first chamber 208 and a second chamber of a vane cell adjuster with a pulse duty factor of 100% according to teachings of the present disclosure.

FIG. 4 shows the position of the control piston 301 for controlling the supply of fluid into the at least one first chamber 208 and the at least one second chamber 209 with a pulse duty factor of 100%. The adjuster 300 in FIG. 4 corresponds to the adjuster 300 from FIG. 3. A pulse duty factor of 100% corresponds in the embodiment to the state in which the control piston 301 is in a first extreme position and the spring 302 is completely compressed.

In this setting of the control piston 301, pressurized fluid can flow through the connection 305 to the first fluid line 304 which leads to the first chamber 208. Simultaneously, fluid can flow through the second fluid line 306, leading to the second chamber 209, through the second connection 307 to a fluid trough. This setting causes additional pressurized fluid to flow into the at least one first chamber 208, and fluid to flow from the at least one second chamber 209. As a result, the volume of the at least one first chamber 208 increases, and the volume of the at least one second chamber 209 decreases. This has the result in the exemplary embodiment in FIG. 2 that the inner ring 204 of the vane cell adjuster 200 rotates in a counter-clockwise direction, and the state in which fluid flows via the leaks from the at least one first chamber 208 into the at least one second chamber 209 is equalized.

Figure 5:
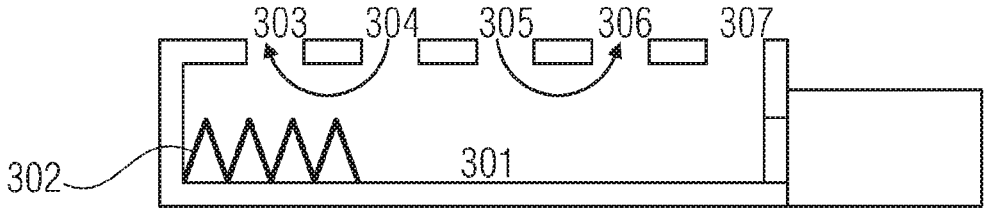
FIG. 5 shows the position of the control piston for controlling the supply of fluid into a first chamber 208 and a second chamber of a vane cell adjuster with a pulse duty factor of 0% according to teachings of the present disclosure.

FIG. 5 shows the position of the control piston 301 for controlling the supply of fluid into the at least one first chamber 208 and the at least one second chamber 209 with a pulse duty factor of 0%. The adjuster 300 in FIG. 5 corresponds to the adjuster 300 from FIG. 3. A pulse duty factor of 0% corresponds in this embodiment to the state in which the control piston 301 is in a second extreme position and the spring 302 is completely extended.

In this setting of the control piston 301, pressurized fluid can flow through the connection 305 to the second fluid line 306 which leads to the at least one second chamber 209. At the same time, fluid can flow through the first fluid line 304, which leads to the at least one first chamber 208, through the first outflow 303 to a fluid trough. This setting has the result that additional pressurized fluid flows into the at least one second chamber 209, and fluid flows from the at least one first chamber 208. As a result, the volume of the at least one second chamber 209 increases, and the volume of the at least one first chamber 208 decreases. This has the result in the exemplary embodiment in FIG. 2 that the inner ring 204 of the vane cell adjuster 200 rotates in the clockwise direction, and the state in which fluid flows via the leaks from the at least one second chamber 209 into the at least one first chamber 208 is equalized.

In addition it is to be noted that "comprising" does not preclude any other elements or steps and "a" or "an" does not preclude a multiplicity. In addition it is to be noted that features or steps which have been described with reference to one of the above exemplary embodiments can also be used in combination with other features or steps of other exemplary embodiments described above.

LIST OF REFERENCE NUMBERS

First method step 101
Second method step 102
Third method step 103
Actuator element/Vane cell adjuster 200
Camshaft 201
Adjustment 202
Leak 203
Inner ring 204
Outer ring 205
Inner dividing wall 206
Outer dividing wall 207
First chamber 208
Second chamber 209
Shaft 210
Adjuster 300
Control piston 301
Spring 302
First outflow 303
First fluid line 304
Connection 305
Second fluid line 306
Second outflow 307

What is claimed is:

1. A method for adjusting a hydraulic actuator element for a camshaft of an internal combustion engine, wherein the hydraulic actuator element is coupled to the camshaft to adjust a camshaft setting, the method comprising:

determining a leakage flow within the actuator element based at least in part on an operating parameter of a camshaft-driven component of the internal combustion engine that imposes a torque on the camshaft; and controlling a mass flow of a hydraulic fluid to and from the hydraulic actuator element to adjust a setpoint setting of the hydraulic actuator element based at least in part on the determined leakage flow within the hydraulic actuator element, wherein controlling the mass flow of the hydraulic fluid to adjust the setpoint setting of the hydraulic actuator element as a function of the determined leakage flow within the hydraulic actuator element equalizes a fluid flow in the hydraulic actuator element and thereby resists a torque-based physical adjustment of the hydraulic actuator element caused by a physical transmission of the torque imposed on the camshaft by the camshaft-driven component to the hydraulic actuator element.

2. The method as claimed in claim 1, wherein the hydraulic actuator element includes a vane cell adjuster.

3. The method as claimed in claim 2, wherein the vane cell adjuster comprises an inner ring and an outer ring spaced apart radially from the inner ring defining a volume between the inner ring and the outer ring, wherein the inner ring rotates relative to the outer ring;

the inner ring includes an inner dividing wall projecting radially into the volume;

the outer ring includes an outer dividing wall projecting radially into the volume;

the inner dividing wall and the outer dividing wall form a spaced-apart first chamber and a second chamber in a circumferential direction;

wherein the hydraulic fluid at a first pressure feeds into the first chamber; and the hydraulic fluid at a second pressure feeds into the second chamber;

adjustment of the inner ring with respect to the outer ring depends on the first pressure and the second pressure;

wherein a setting of the inner ring relative to the outer ring corresponds to the camshaft setting.

4. The method as claimed in claim 3, wherein:

the vane cell adjuster comprises a shaft coupled to either the inner ring or the outer ring and to the camshaft; and adjustment of the shaft causes adjustment of the camshaft.

5. A method for operating an internal combustion engine including a hydraulic actuator element for a camshaft of the internal combustion engine, wherein the hydraulic actuator element is coupled to the camshaft to adjust a camshaft setting, the method comprising:

determining a leakage flow within the actuator element based at least in part on an operating parameter of a camshaft-driven component of the internal combustion engine that imposes a torque on the camshaft;

controlling a mass flow of a hydraulic fluid to and from the hydraulic actuator element to adjust a setpoint setting of the hydraulic actuator element based at least in part on the determined leakage flow within the hydraulic actuator element, wherein controlling the mass flow of the hydraulic fluid to adjust the setpoint setting of the hydraulic actuator element as a function of the determined leakage flow within the hydraulic actuator element equalizes a fluid flow in the hydraulic actuator element and thereby resists a torque-based physical adjustment of the hydraulic actuator element caused by a physical transmission of the torque imposed on the camshaft by the camshaft-driven component to the hydraulic actuator element; and driving the camshaft at the camshaft setting by combusting fuel in a piston chamber of the internal combustion engine.

6. An engine control unit for an internal combustion engine including a hydraulic actuator element for a camshaft of the internal combustion engine, wherein the hydraulic actuator element is coupled to the camshaft to adjust a camshaft setting, the engine control unit comprising a processor configured to:

determine a leakage flow within the actuator element based at least in part on an operating parameter of a camshaft-driven component of the internal combustion engine that imposes a torque on the camshaft; and control a mass flow of a hydraulic fluid to and from the hydraulic actuator element to adjust a setpoint setting of the hydraulic actuator element based at least in part on the determined leakage flow within the hydraulic actuator element, wherein controlling the mass flow of the hydraulic fluid to adjust the setpoint setting of the hydraulic actuator element as a function of the determined leakage flow within the hydraulic actuator element equalizes a fluid flow in the hydraulic actuator element and thereby resists a torque-based physical adjustment of the hydraulic actuator element caused by a physical transmission of the torque imposed on the camshaft by the camshaft-driven component to the hydraulic actuator element.

7. A non-transitory computer-readable storage device storing a computer program for adjusting a hydraulic actuator element for a camshaft of an internal combustion engine, wherein the hydraulic actuator element is coupled to the camshaft to adjust a camshaft setting, the computer program executable by a processor to:

determine a leakage flow within the actuator element based at least in part on an operating parameter of a camshaft-driven component of the internal combustion engine that imposes a torque on the camshaft; and control a mass flow of a hydraulic fluid to and from the hydraulic actuator element to adjust a setpoint setting of the hydraulic actuator element based at least in part on the determined leakage flow within the hydraulic actuator element, wherein controlling the mass flow of the hydraulic fluid to adjust the setpoint setting of the hydraulic actuator element as a function of the determined leakage flow within the hydraulic actuator element equalizes a fluid flow in the hydraulic actuator element and thereby resists a torque-based physical adjustment of the hydraulic actuator element caused by a physical transmission of the torque imposed on the camshaft by the camshaft-driven component to the hydraulic actuator element.

* * * * *